US010913276B2

(12) United States Patent
Tanaka

(10) Patent No.: US 10,913,276 B2
(45) Date of Patent: Feb. 9, 2021

(54) LIQUID JETTING HEAD AND LIQUID JETTING APPARATUS

(71) Applicant: Brother Kogyo Kabushiki Kaisha, Nagoya (JP)

(72) Inventor: Taiki Tanaka, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/174,381

(22) Filed: Oct. 30, 2018

(65) Prior Publication Data

US 2019/0283429 A1 Sep. 19, 2019

(30) Foreign Application Priority Data

Mar. 16, 2018 (JP) ..... 2018-048904

(51) Int. Cl.
*B41J 2/16* (2006.01)
*B41J 2/165* (2006.01)

(52) U.S. Cl.
CPC ..... *B41J 2/16535* (2013.01); *B41J 2/16505* (2013.01)

(58) Field of Classification Search
None
See application file for complete search history.

(56) References Cited

U.S. PATENT DOCUMENTS

2006/0066690 A1* 3/2006 Katayama ..... B41J 2/14201 347/71
2012/0092408 A1* 4/2012 Yamamori ..... B41J 2/04528 347/17
2013/0187976 A1* 7/2013 Kobayashi ..... B41J 2/14233 347/19

FOREIGN PATENT DOCUMENTS

JP 2011-161852 A 8/2011

* cited by examiner

*Primary Examiner* — Erica S Lin
(74) *Attorney, Agent, or Firm* — Banner & Witcoff, Ltd.

(57) ABSTRACT

A liquid jetting head, includes: a nozzle plate having a nozzle surface in which nozzles are open, the nozzles being aligned on the nozzle surface in a first direction to form nozzle rows; a cover which is in thermal contact with ends in the first direction of the nozzle plate; and at least one heater which is in thermal contact with the cover and which is configured to heat the cover.

19 Claims, 13 Drawing Sheets

LIQUID JETTING HEAD AND LIQUID JETTING APPARATUS

CROSS REFERENCE TO RELATED APPLICATION

The present application claims priority from Japanese Patent Application No. 2018-048904 filed on Mar. 16, 2018, the disclosure of which is incorporated herein by reference in its entirety.

BACKGROUND

Field of the Invention

The present invention relates to a liquid jetting head jetting a liquid and a liquid jetting apparatus including the liquid jetting head.

Description of the Related Art

There are different types of liquids jetted from a liquid jetting head, such as an ink-jet head. The viscosity suitable for jetting thereof depends on the type of the liquid. The viscosity of the liquid relates to temperature. The viscosity increases as the temperature is lower. There is thus suggested a liquid jetting head including a heater that heats a liquid to regulate the liquid viscosity when the liquid jetting head is placed in an environment at a low temperature and/or the liquid jetting head jets a liquid having high viscosity (see, for example, Japanese Patent Application Laid-open No. 2011-161852).

The liquid jetting head disclosed in Japanese Patent Application Laid-open No. 2011-161852 includes: a nozzle forming member (nozzle plate) including a nozzle surface in which nozzles are formed; a cover that is in contact with an outer edge of the nozzle plate to cover the nozzles; and a heater that heats the liquid in liquid channels provided in the liquid jetting head. The heater is connected to the cover. Heating the cover by the heater allows the liquid in the nozzle plate making contact with the cover to be heated. Heating both the liquid in the liquid channels and the liquid in the nozzle plate heats the liquid jetting head entirely and efficiently, making it possible to regulate the viscosity of the liquid to be jetted from the head.

The cover, which conducts the heat from the heater to the nozzle plate, protects the nozzle surface from the contact with a recording medium, and the like. The cover is thus disposed on a recording medium side of the nozzle surface such that the cover partially overlaps with the nozzle surface.

In a liquid jetting apparatus, such as an ink-jet printer, in which the above liquid jetting head is installed, the nozzle surface is preferably subjected to regular cleaning. For example, cleaning (wiping) is performed with a wiper made using an elastic material to wipe off dirt on the nozzle surface.

A step, however, is generated between the nozzle surface and the cover when the nozzle surface is covered partially with the cover. In that case, for example, the nozzle surface in the vicinity of the step may not be wiped satisfactorily with the wiper. Further, the liquid and the like collected at a front end of the wiper that has wiped the nozzle surface may be caught by the step. As described above, there is a problem in which the nozzle surface in the vicinity of the cover is not likely to be satisfactorily wiped during the cleaning.

In order to reduce costs, a liquid jetting head developed recently may use a small nozzle plate (i.e., a nozzle plate provided with a nozzle surface that is small in area). The above wiping problem is particularly conspicuous or prominent when the small nozzle plate is used. In the small nozzle plate, a distance between the cover and nozzles formed in the nozzle surface is short, and the nozzles are arranged in the vicinity of the cover. When the nozzles in the vicinity of the cover are not cleaned satisfactorily, the unclean nozzles may have jetting failure and the like.

The present teaching has been made in view of the above circumstances, and an object of the present teaching is to provide a liquid jetting head that is capable of regulating viscosity of a liquid to be jetted from a head through heating of a nozzle plate and easily performing cleaning (wiping) of a nozzle surface with a wiper.

SUMMARY

According to a first aspect of the present teaching, there is provided a liquid jetting head, including:

a nozzle plate having a nozzle surface in which nozzles are open, the nozzles being aligned on the nozzle surface in a first direction to form nozzle rows;

a cover which is in thermal contact with ends in the first direction of the nozzle plate; and at least one heater which is in thermal contact with the cover and which is configured to heat the cover.

According to a second aspect of the present teaching, there is provided a liquid jetting apparatus, including:

the liquid jetting head as defined in the first aspect; and a wiper configured to wipe the nozzle surface of the liquid jetting head.

DESCRIPTION OF THE EMBODIMENTS

Figure 1:
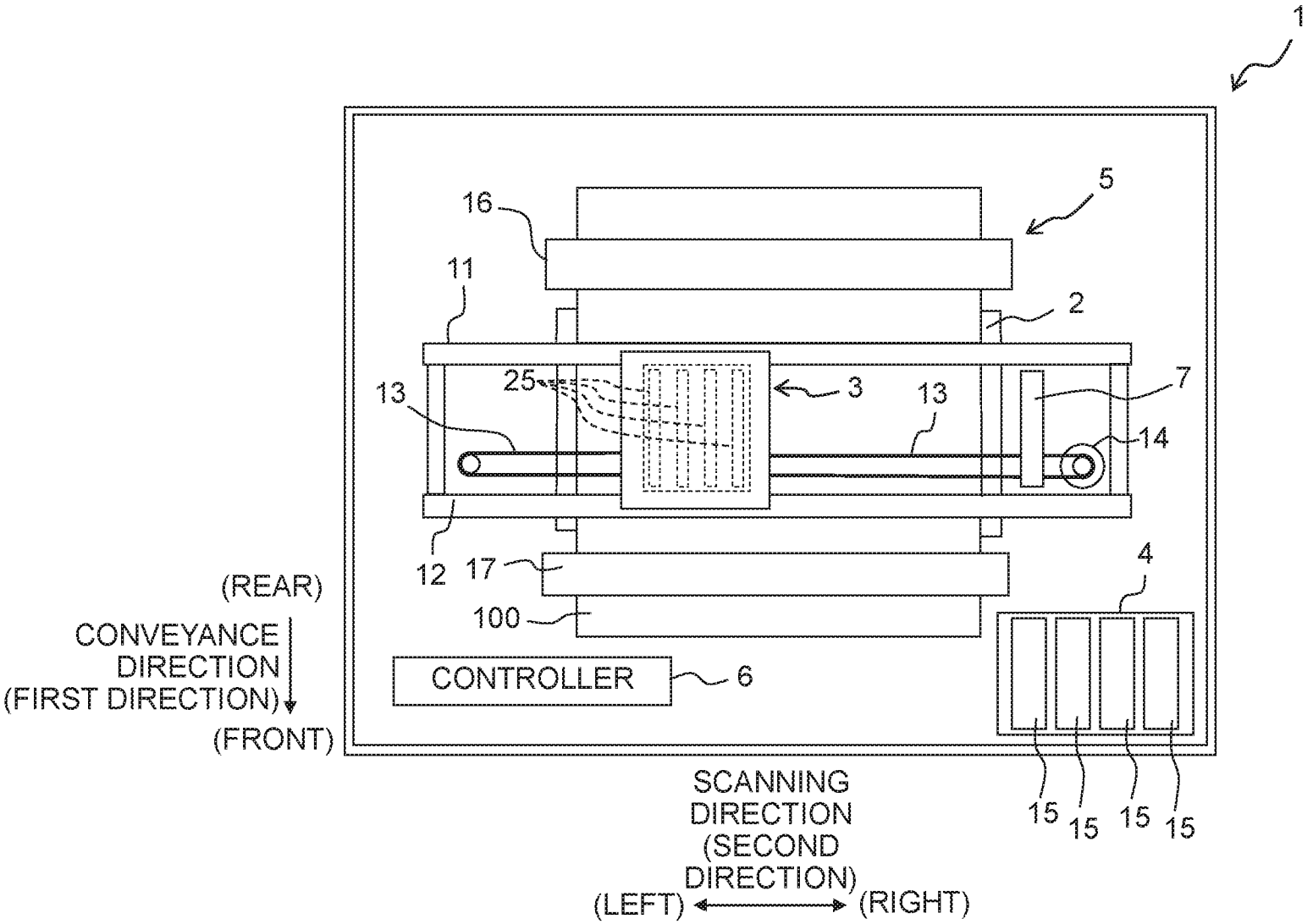
FIG. 1 is a top view schematically depicting an ink-jet printer (liquid jetting apparatus) according to an embodiment.

Referring to FIG. 1, a schematic configuration of an ink-jet printer 1 according to an embodiment of the present teaching is explained. Front, rear, left, and right directions as indicated in FIG. 1 are respectively defined as front (frontward), rear (rearward), left (leftward) and right (rightward) of the ink-jet printer 1. Further, the fore side (front side) of the sheet surface of FIG. 1 is defined as up (upward), and the far side (the other side) of the sheet surface of FIG. 1 is defined as down (downward). The following explanation is made based on those definitions.

<Schematic Configuration of Printer>

As depicted in FIG. 1, the ink-jet printer (liquid jetting apparatus) 1 includes a platen 2, an ink-jet head (liquid jetting head) 3, a cartridge holder 4, a conveyance mechanism 5, a controller 6, a wiper 7, and the like.

A recording medium 100 such as recording paper is placed on an upper surface of the platen 2. The ink-jet head 3 includes four head units 25 that jet ink to the recording medium 100 placed on the platen 2. The ink-jet head 3 is configured to reciprocate in a left-right direction (hereinafter also referred to as a scanning direction) in an area facing the platen 2 along two guide rails 11 and 12. An endless belt 13 is coupled to the ink-jet head 3. Driving the endless belt 13 by a drive motor 14 moves the ink-jet head 3 in the scanning direction. The ink-jet head 3 jets the ink from nozzles of each head unit 25 to the recording medium 100 placed on the platen 2 while moving in the scanning direction. The configuration of the ink-jet head 3 is described below in detail.

Ink cartridges 15 of four colors (black, yellow, cyan, and magenta) are removably installed in the cartridge holder 4. The cartridge holder 4 is connected to the ink-jet head 3 via tubes (not depicted). The inks of four colors in the four ink cartridges 15 installed in the cartridge holder 4 are supplied to the ink-jet head 3 via the tubes.

The conveyance mechanism 5 includes two conveyance rollers 16 and 17 that are arranged in a front-rear direction with the platen 2 intervening therebetween. The two conveyance rollers 16 and 17 are driven while being synchronized to each other by a conveyance motor (not depicted). The conveyance mechanism 5 conveys the recording paper 100 placed on the platen 2 in a forward direction (hereinafter also referred to as a conveying direction or conveyance direction) by the two conveyance rollers 16 and 17.

The controller 6 includes a Read Only Memory (ROM), a Random Access Memory (RAM), an Application Specific Integrated Circuit (ASIC) including various control circuits, and the like. The controller 6 controls the ASIC to perform various kinds of processing, such as printing onto the recording paper 100 by the ink-jet head 3, in accordance with programs stored in the ROM.

For example, in print processing, the controller 6 controls the ink-jet head 3, the drive motor 14, the conveyance motor (not depicted) of the conveyance mechanism 5, and the like in accordance with a printing command inputted from an external apparatus such as a PC, to print an image and the like on the recording medium 100. Specifically, the controller 6 performs an ink-jetting operation and a conveyance operation alternately. In the ink-jetting operation, the ink is jetted from the nozzles of each of the four head units 25 of the ink-jet head 3 during movement of the ink-jet head 3 in the scanning direction. In the conveyance operation, the recording medium 100 is conveyed in the conveying direction by a predefined amount by use of the conveyance rollers 16 and 17 of the conveyance mechanism 5.

The wiper 7 is a spatula-like member made using an elastic material, such as rubber. The wiper 7 is disposed on one side (a right side in FIG. 1) in the scanning direction relative to the platen 2. The ink-jet head 3 is movable along the two guide rails 11 and 12 to an area where the wiper 7 is disposed. The wiper 7 performs cleaning (wiping) during the movement of the ink-jet head 3. In the cleaning, the wiper 7 wipes a nozzle surface 38*a* (see, FIGS. 7 and 8) of the ink-jet head 3. The wiper 7 performs the cleaning by wiping the nozzle surface 38*a* in the scanning direction.

Figure 7:
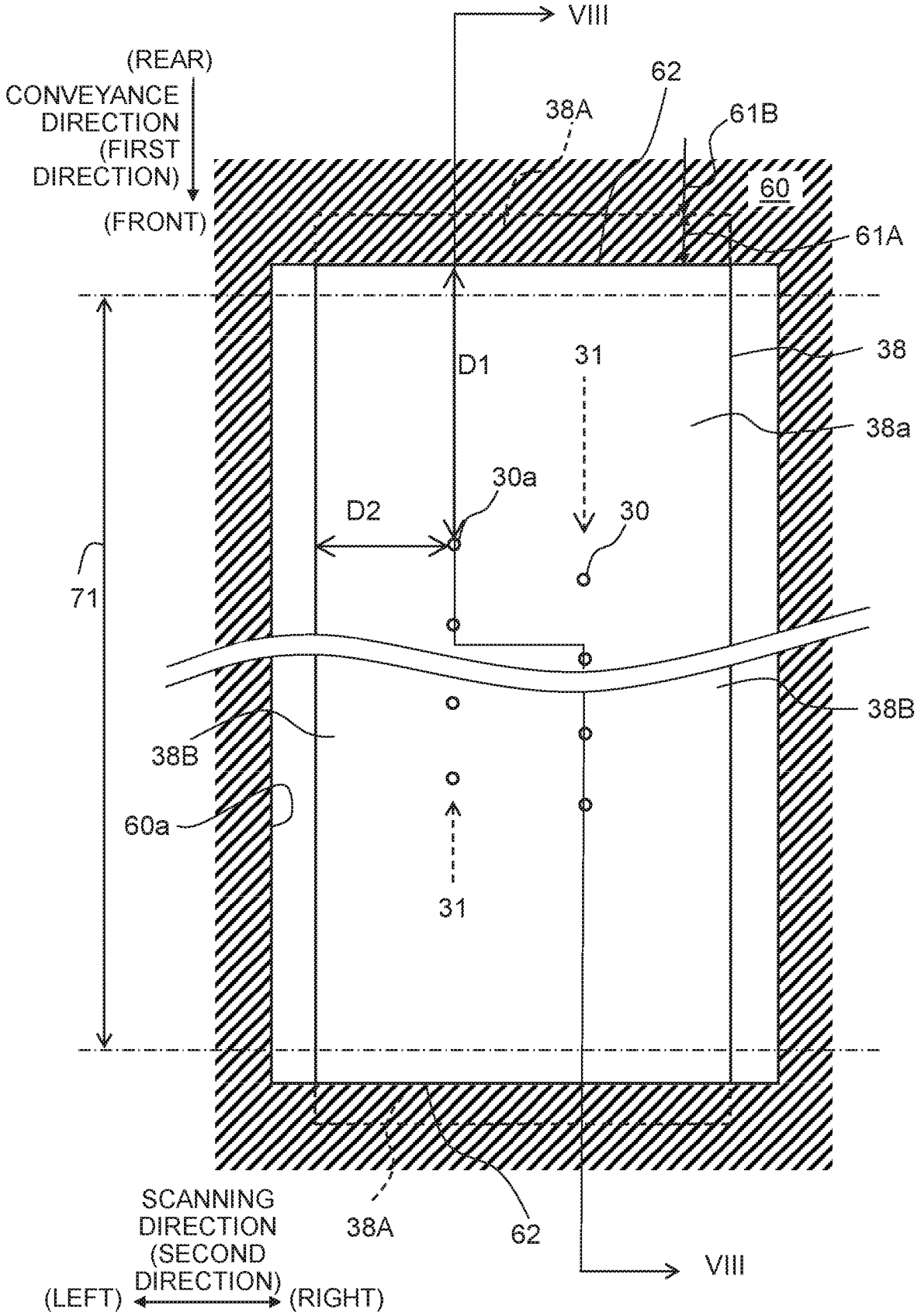
FIG. 7 is a plan view schematically depicting a cover and a nozzle plate.
Figure 8:
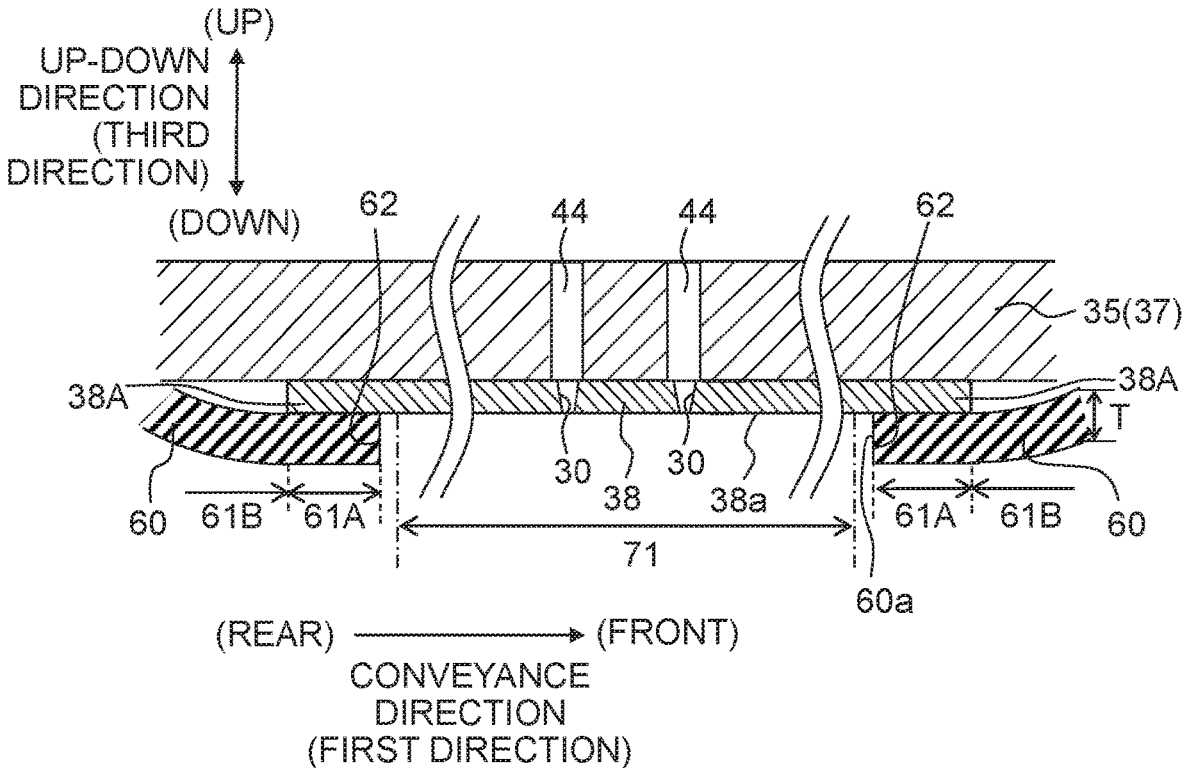
FIG. 8 schematically depicts a cross-section taken along a line VIII-VIII of FIG. 7.

FIGS. 7 and 8 depict a wiper area 71 of the nozzle surface 38*a*. The wiper 7 wipes the wiper area 71 during the cleaning. A cover 60 described below is disposed outside the wiper area 71 in the conveying direction.

In the following, a direction parallel to the conveying direction is referred to as a first direction in some cases, and the scanning direction is referred to as a second direction in some cases. The first direction intersects with the second direction. In this embodiment, the first direction is orthogonal to the second direction. An up-down direction perpendicular to the first and second directions is referred to as a third direction in some cases.

<Detailed Configuration of Ink-Jet Head>

Figure 2:
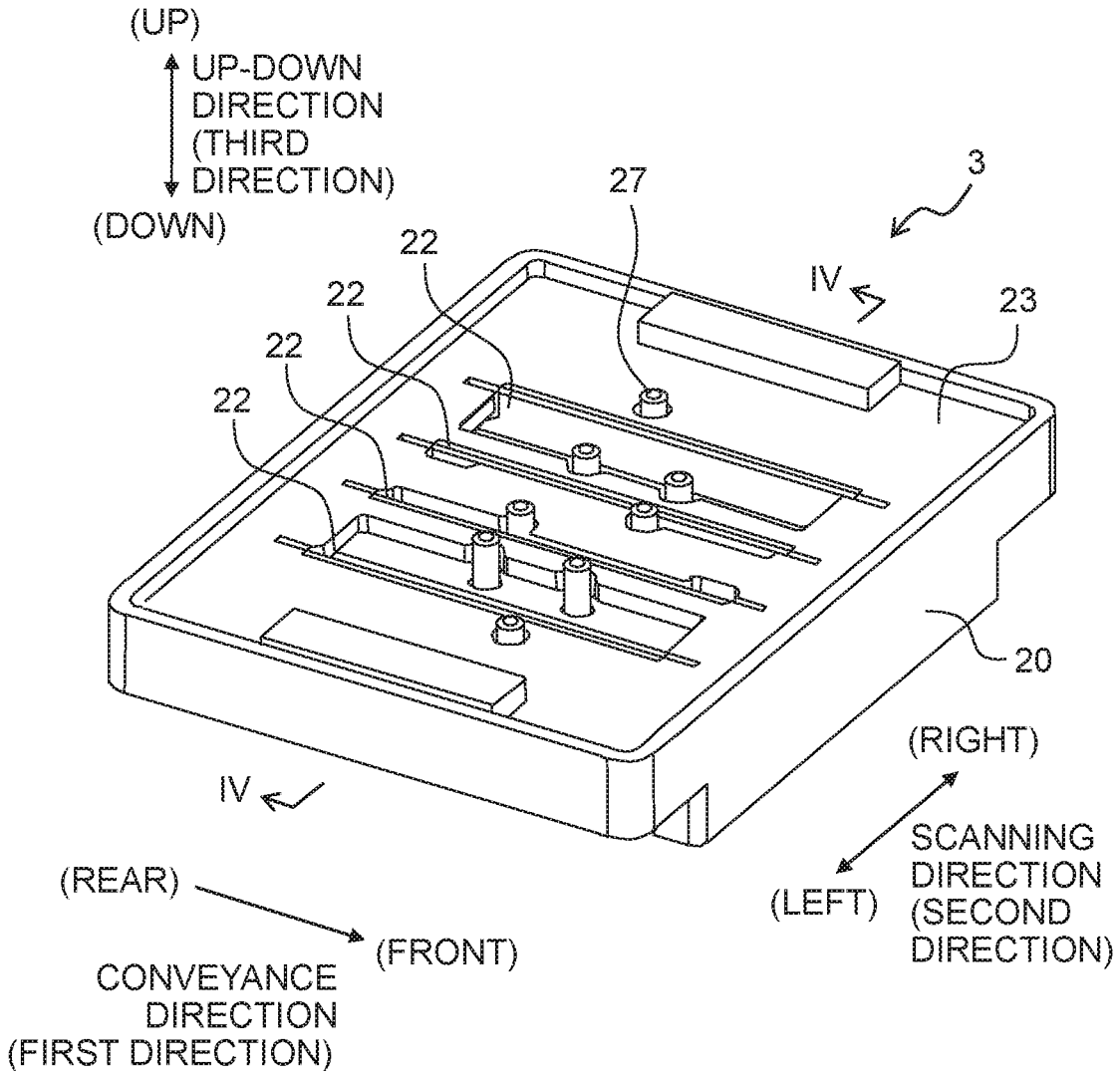
FIG. 2 is a perspective view of an ink-jet head (liquid jetting head) according to the embodiment.
Figure 3:
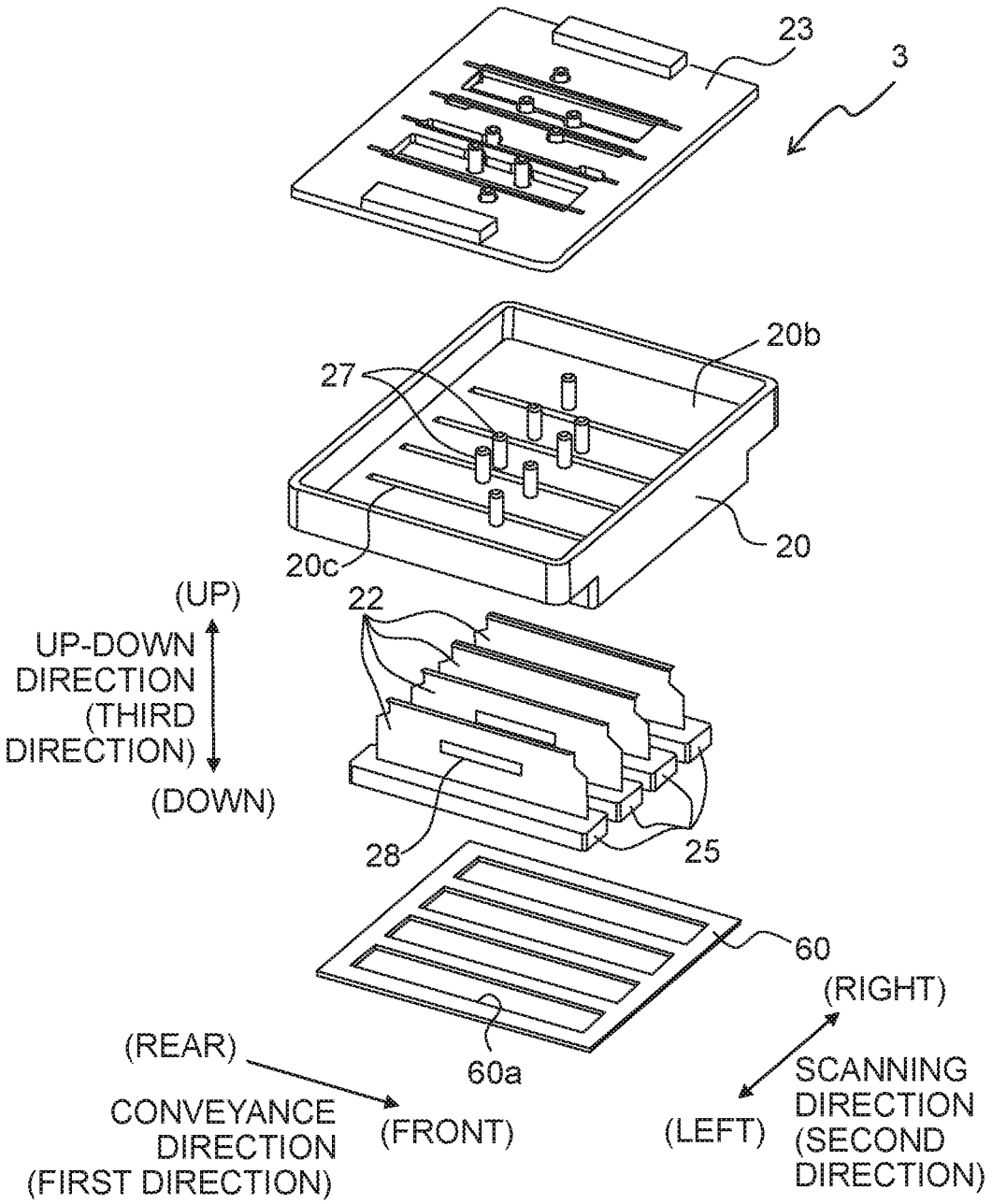
FIG. 3 is an exploded perspective view of the ink-jet head according to the embodiment.
Figure 4:
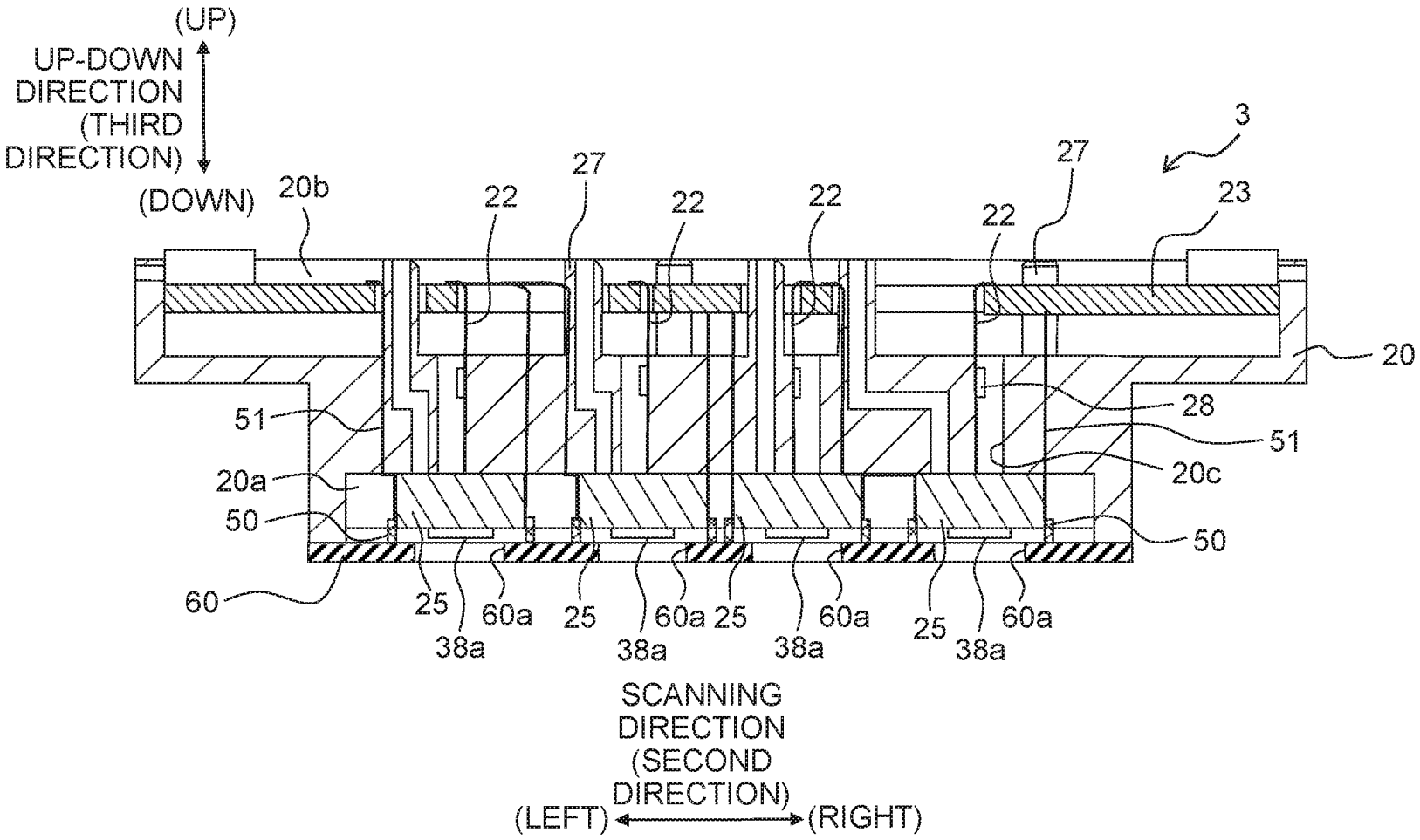
FIG. 4 schematically depicts a cross-section taken along a line IV-IV of FIG. 2.

Subsequently, a detailed configuration of the ink-jet head 3 is explained. As depicted in FIGS. 2 to 4, the ink-jet head 3 includes a head holder 20, the four head units 25, four pieces of COF 22, a circuit board 23, heaters 50 (see FIG. 6), the cover (nozzle cover) 60, and the like.

<Head Holder>

The head holder 20 has a rectangular shape in plan view, and the head holder 20 is long in the scanning direction. The head holder 20 is coupled to the endless belt 13 (see FIG. 1) driven by the drive motor 14. The head holder 20 is movable along the guide rails 11 and 12 in the scanning direction. As depicted in FIGS. 3 and 4, a lower portion of the head holder 20 is formed as a recessed unit accommodating portion 20*a*. The unit accommodating portion 20*a* accommodates the four head units 25. An upper portion of the head holder 20 is formed as a recessed board accommodating portion 20*b*. The board accommodating portion 20*b* accommodates the circuit board 23.

As depicted in FIGS. 3 and 4, the board accommodating portion 20*b* of the head holder 20 is provided with eight cylindrical flow channels 27 each including an ink flow channel and extending upward from a bottom surface of the board accommodating portion 20*b*. The eight cylindrical flow channels 27 correspond respectively to eight nozzle rows 31 (described below) of the four head units 25. The eight cylindrical flow channels 27 are connected to the cartridge holder 4 (see FIG. 1), and the four color inks in the four ink cartridges 15 installed in the cartridge holder 4 are supplied to the eight cylindrical flow channels 27. Note that one color ink, among the four color inks, supplied from one ink cartridge 15 among the four ink cartridges 15 is supplied to two cylindrical flow channels 27 among the eight cylindrical flow channels 27. Further note that, although omitted in FIG. 4, the ink flow channels connecting the eight cylindrical flow channels 27 and the four head units 25 are formed inside the head holder 20. As depicted in FIGS. 3 and 4, the head holder 20 includes four passing holes 20*c* through which the four COFs 22 corresponding to the four head units 25 pass, respectively.

<Head Unit>

As depicted in FIGS. 3 and 4, the four head units 25 are accommodated in the unit accommodating portion 20*a* of the head holder 20 such that they are arranged in the scanning direction with intervals.

Figure 5:
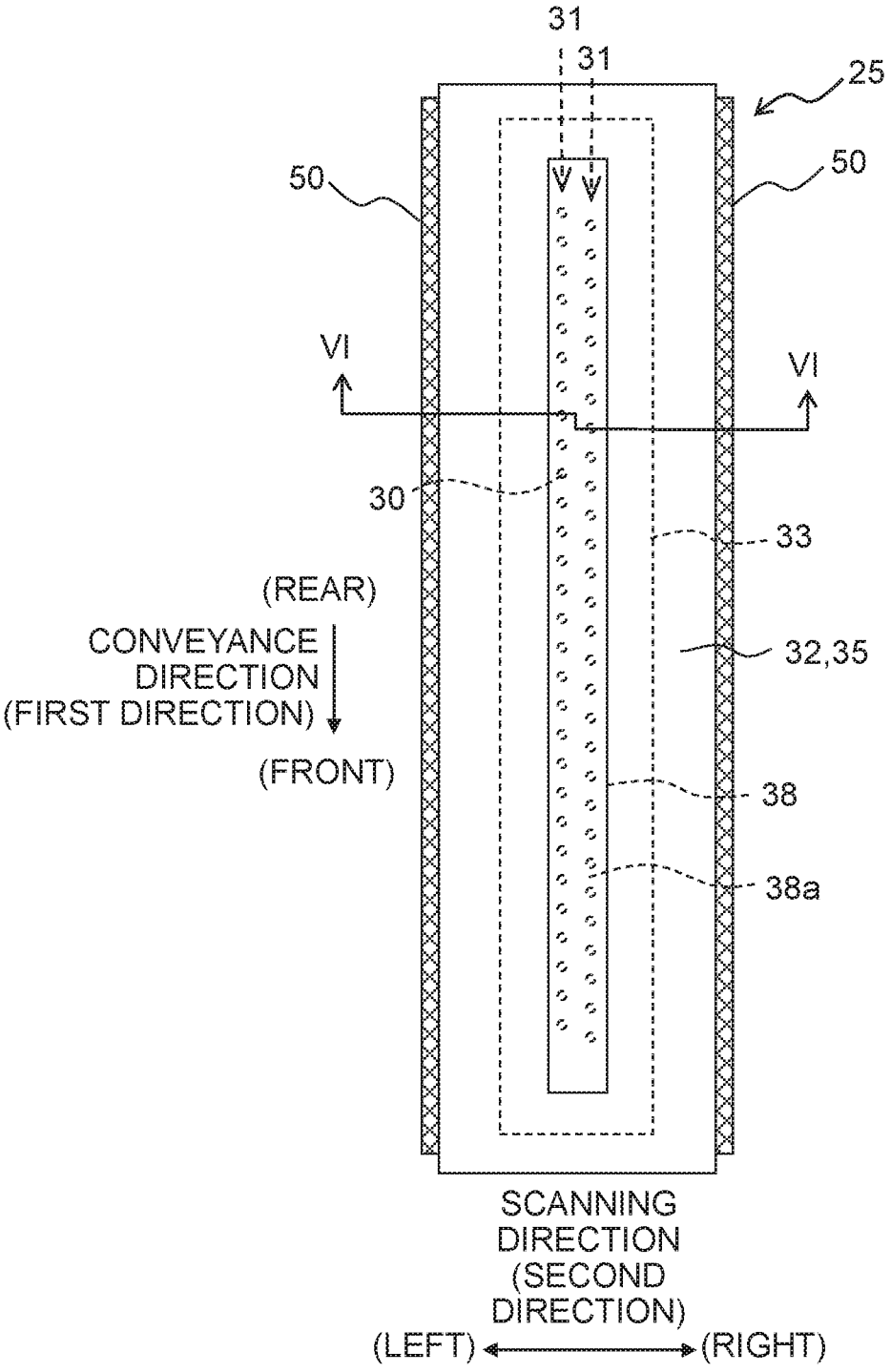
FIG. 5 is a plan view schematically depicting a head unit and heaters that are provided on both sides in a scanning direction of the head unit.
Figure 6:
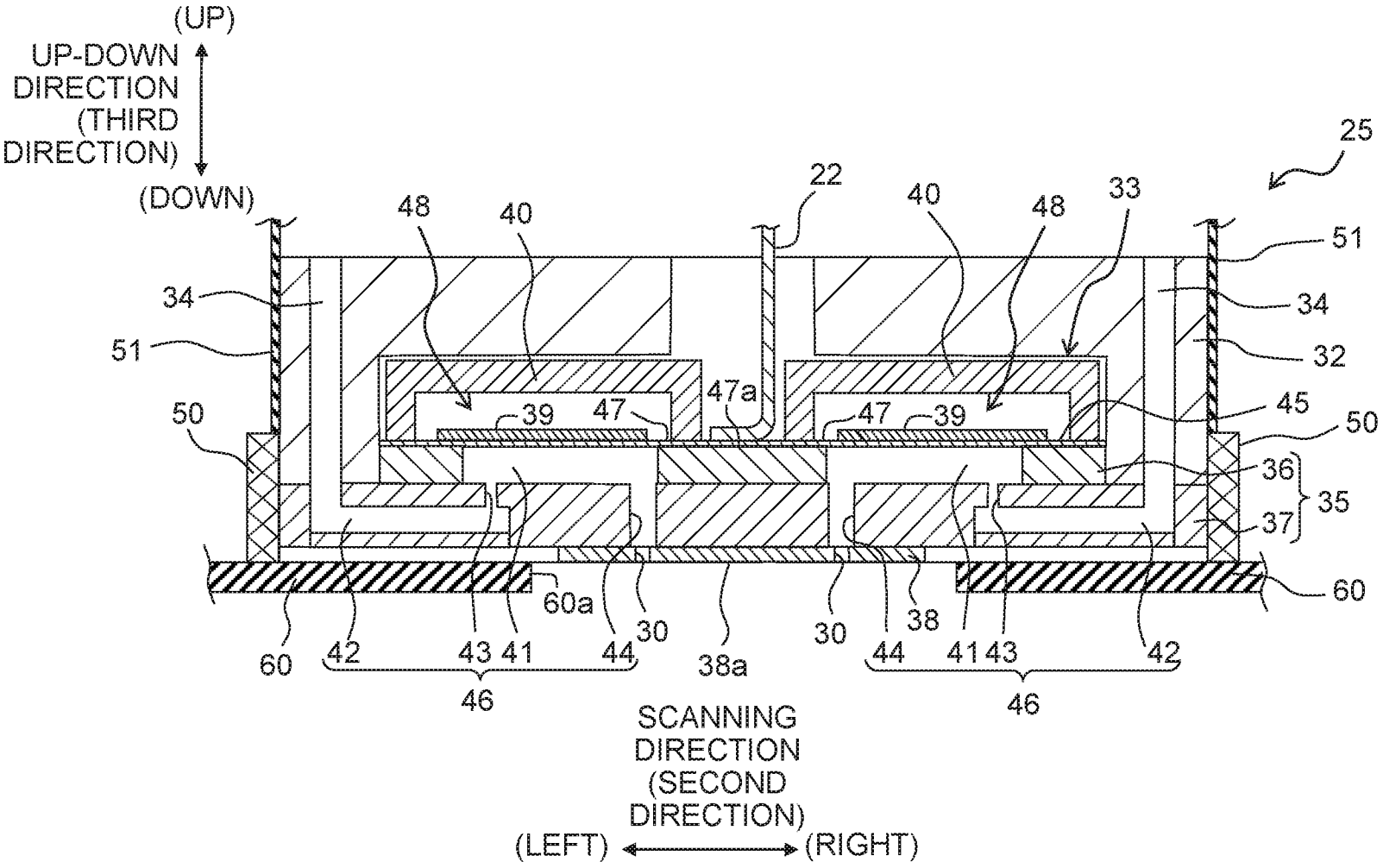
FIG. 6 schematically depicts a cross-section taken along a line VI-VI of FIG. 5.

For easy understanding of the configurations of the head unit 25 and the heaters 50, only the head unit 25 and the heaters 50 are depicted in FIG. 5 and the cover 60 is omitted (not depicted) in FIG. 5. Meanwhile, FIG. 6 depicts not only the head unit 25 and the heater 50 but also the cover 60. As depicted in FIGS. 5 and 6, each of the head units 25 includes a nozzle plate 38 at its lowest position, namely at a position closest to the recording medium 100. Nozzles 30 are formed in the nozzle plate 38. A lower surface of the nozzle plate 38, namely a surface having the nozzles 30 and facing the recording medium 100 is the nozzle surface (ink jetting surface) 38*a*. The nozzles 30 in the nozzle surface 38*a* are aligned in the conveying direction (first direction) to form nozzle rows 31, which are arranged in the scanning direction (second direction). In this embodiment, each of the head units 25 includes two nozzle rows 31.

Since each of the four head units 25 has the two nozzle rows 31, the ink-jet head 3 has a total of eight nozzle rows 31. The eight nozzle rows 31 correspond respectively to the eight cylindrical flow channels 27 of the head holder 20, and any one of the four color inks is supplied to each of the nozzle rows 31 from one of the cylindrical flow channels 27 corresponding thereto. Namely, one of the color inks that is supplied from one of the ink cartridges 15 (see FIG. 1) to the ink-jet head 3 is supplied to two nozzle rows 31 among the eight nozzle rows 31, via two cylindrical flow channels 27 among the eight cylindrical flow channels 27. Note that as to which one of the eight nozzle rows 31 is allowed to jet which one of the color inks is not limited to any particular combination of the nozzle row and the color of the inks, and a selection may be made as appropriate. For example, two nozzle rows 31 of one of the head units 25 may be configured to jet the same color of ink. Alternatively, four kinds of the nozzle row 31 respectively jetting the four color inks may be arranged left-right symmetrically in the scanning direction. For example, the four kinds of the nozzle row 31 may be arranged from the center in the scanning direction toward the left and right sides, in an order of the black, magenta, cyan and yellow inks.

Next, the configuration of the head units 25 is specifically explained. As depicted in FIG. 5, each of the head units 25 has an outer shape that is substantially rectangular in plan view and elongated in the conveying direction. Further, as depicted in FIG. 6, the head unit 25 has a holder member 32 and a body 33 of the head (head body 33) held by the holder member 32. Two ink supply channels 34 are formed in the holder member 32. These two ink supply channels 34 are connected to two cylindrical flow channels 27 among the eight cylindrical flow channels 27 via ink flow channels (not depicted in the drawings) formed inside the head holder 20.

The head body 33 has a first flow channel substrate 36, a second flow channel substrate 37, a nozzle plate 38, piezoelectric elements 39, a protective member 40, and the like.

The first flow channel substrate 36 includes pressure chambers 41. The pressure chambers 41 correspond to the nozzles 30 and are arranged in the conveying direction to form two pressure chamber rows which are arranged side by side with each other in the scanning direction. Further, the first flow channel substrate 36 has a vibration film 45 covering the pressure chambers 41.

The second flow channel substrate 37 is joined to a lower surface of the first flow channel substrate 36. The second flow channel substrate 37 includes two manifolds 42 communicating respectively with the two ink flow channels 34 of the holder member 32. The ink supplied from the ink cartridge 15 (see FIG. 1) to the cylindrical flow channel 27 is supplied to the manifold 42 via the ink flow channel 34 of the holder member 32.

The two manifolds 42 extend in the conveying direction (a direction perpendicular to the sheet surface of FIG. 6) at areas in each of which one of the manifolds 42 overlaps with the pressure chambers 41 of the first flow channel substrate 36. The second flow channel substrate 37 includes communicating holes 43 each of which allows one of the pressure chambers 41 to communicate with either one of the two manifolds 42. The second flow channel substrate 37 also includes communicating holes 44 each allowing one of the pressure chambers 41 to communicate with one of the nozzles 30 formed in the nozzle plate 38 (described below).

As described above, a liquid channel 46 communicating with the nozzle 30 is configured by the manifold 42, the communicating hole 43, the pressure chamber 41, and communicating hole 44. The first channel substrate 36 and the second channel substrate 37 configure a channel forming member 35 in which the liquid channels 46 are formed. The channel forming member 35 (a first surface of the channel forming member 35) is connected to an upper surface of the nozzle plate 38, namely a surface of the nozzle plate 38 on a side opposite to the nozzle surface 38.

The nozzle plate 38, which is a plate-like member extending in the conveying direction (first direction), is joined to a lower surface of the second flow channel substrate 37. The nozzle plate 38 includes the nozzles 30 aligned in the conveying direction. As described above, the nozzles 30 form two nozzle rows 31. Each of the nozzles 30 communicates with one of the pressure chambers 41 formed in the first flow channel substrate 36, via one of the communicating holes 44 formed in the second flow channel substrate 37. As depicted in FIG. 5, the length in the scanning direction (second direction) of the nozzle plate 38 is shorter than the length in the scanning direction of the channel forming member 35 (second channel substrate 37) connected to the nozzle plate 38. For example, the length (width) in the scanning direction of the channel forming member 35 is 6 to 7 mm, and the length (width) in the scanning direction of the nozzle plate 38 is 1 to 2 mm.

The piezoelectric elements (actuators) 39 are arranged on an upper surface of the vibration film 45 that is parallel to the nozzle surface 38*a*. The piezoelectric elements (actuators) 39 connect to a second surface of the channel forming member 35 on a side opposite to the first surface which connect to the nozzle plate 38. The piezoelectric elements 39 are aligned in the conveying direction corresponding to the pressure chambers 41, respectively, and form two piezoelectric element rows 48 that are arranged side by side with each other in the scanning direction. Each of the piezoelectric elements 39 causes the vibration film 45 to vibrate by using the piezoelectric deformation generated when the voltage applied to the piezoelectric element 39 is changed, to thereby apply jetting energy for jetting the ink from the nozzles 30 to the ink inside a certain pressure chamber 41, among the pressure chambers 41. Drive traces 47 are connected to the piezoelectric elements 39, respectively, and a predefined driving voltage is applied to each of the piezoelectric element 39 via one of the drive traces 47 connected thereto. Each of the drive traces 47 is drawn from one of the piezoelectric elements 39 toward the inner side in the scanning direction. An end, of each of the drive traces 47, on a side opposite to one of the piezoelectric elements 39 corresponding thereto is provided with a drive contact point 47*a* to which the COF 22 (described below) is connected. The drive contact points 47*a* of the drive traces 47 are arranged on the upper surface, of the vibration film 45 of the first flow channel substrate 36, in an area between the two piezoelectric element rows 48.

Two protective members 40 covering the two piezoelectric element rows 48, respectively, are arranged on the upper surface of the vibration film 45 of the first flow channel substrate 36. The protective members 40 are arranged for the purpose of, for example, shielding the piezoelectric elements 39 from the outside air, inhibiting the piezoelectric elements 39 from contacting moisture, and the like.

<COF>

As depicted in FIG. 4, the COF (chip on film) 22 as a wiring member or a trace member is connected to each of the head units 25. More specifically, in each of the head units 25, an end of the COF 22 is disposed between the two piezoelectric element rows 48 in the scanning direction, and is electrically connected to the drive contact points 47 which are drawn from the piezoelectric elements 39, respectively, as depicted in FIG. 6. Further, as depicted in FIGS. 3 and 4, the four COFs 22 extend upward respectively from the four head units 25 in a state where the four COFs 22 are arranged side by side with one another in the scanning direction, and are connected to the circuit board 23. Namely, the COFs 22 allow the piezoelectric elements (actuators) 39 to be electrically connected to the circuit board (rigid board) 23. Intermediate portions, of the respective four COFs 22, in the up-down direction are provided with four pieces of IC 28, respectively. Each of the four ICs 28 supplies a driving signal to the piezoelectric elements 39 of one of the head units 25 corresponding thereto, based on a signal input from the circuit board 23 to the IC 28, thereby changing the voltage applied to the piezoelectric elements 39.

<Circuit Board (Rigid Board)>

As depicted in FIGS. 2 to 4, the circuit board (rigid board) 23 is arranged at a position above the four head units 25 with the head holder 20 interposed therebetween, and is accommodated in the board accommodating portion 20*b* of the head holder 20. The circuit board 23 is arranged to overlap with the four head units 25 in the up-down direction. The four COFs 22 extending from the four head units 25 are connected to the circuit board 23.

<Heater>

As depicted in FIGS. 4 to 6, the heaters 50 are provided on both sides of the nozzle plate 38 in the scanning direction (second direction). The heaters 50 are disposed on both sides in the scanning direction (second direction) of the holder member 32 and the channel forming member 35. The heaters 50 come into thermal contact with outer walls of the holder member 32 and the channel forming member 35. In this embodiment, the heaters 50 are in direct contact with the outer walls. The ink supply channels 34 and the manifolds 42 formed in the holder member 32 and the channel forming member 35 are arranged on both sides in the scanning direction of the nozzle plate 38. The heaters 50 thus heat the ink in the ink supply channels 34 and the manifolds 42 through the outer walls of the holder member 32 and the channel forming member 35. Lower ends of the heaters 50 come into thermal contact with the cover 60. In this embodiment, the lower ends of the heaters 50 are in direct contact with the cover 60. This allows the heaters 50 to heat the cover 60. The heaters 50 can have a temperature itself in a range of 40 to 60° C. In the present description, the thermal contact means direct or indirect contact allowing heat to be conducted satisfactorily. Thus, the contact between the heaters 50 and the outer walls of the channel forming member 32 and the like and the contact between the heaters 50 and the cover 60 may be the direct contact or the indirect contact via a heat conductive material such as metal having high thermal conductivity, a thermal conduction adhesive, or the like.

The configuration of the heater 50 is not particularly limited, and it is possible to select and use a general-purpose heater appropriately. For example, the heater 50 may be a film heater in which an electrically heated wire, such as a nichrome wire, is sealed with a belt-like insulator having flexibility. The heater 50 is connected electrically to the circuit board (rigid board) 23 by use of a wiring member 51.

The number of heaters 50 is not particularly limited, and it can be determined appropriately. In this embodiment, each of the head units 25 includes two heaters 50. The ink-jet head 3 thus includes a total of eight heaters 50.

<Cover (Nozzle Cover)>

As depicted in FIGS. 3 and 4, the cover 60 is joined to a lower surface of the head holder 20. The cover 60 has four openings 60*a* corresponding to the four head units 25, respectively. The cover 60 is disposed on a side of the nozzle surface 38*a* of the nozzle plate 38. The cover 60 is disposed below the nozzle plate 38. Namely, a lower surface of the cover 60 is closer to the recording medium 100 than the lower surface (nozzle surface 38*a*) of the nozzle plate 38. This configuration allows the cover 60 to protect the nozzle surface 38*a* of the nozzle plate 38 from hitting against the recording medium 100 and the like.

As depicted in FIGS. 7 and 8, the cover 60 comes into thermal contact with ends 38A in the conveying direction (first direction) of the nozzle plate 38. In this embodiment, the cover 60 is in direct contact with the nozzle plate 38. In that configuration, steps 62 between the nozzle surface 38*a* and the cover 60 are formed, along the scanning direction (second direction), in the ends 38A in the conveying direction (first direction) of the nozzle surface 38*a*. The nozzles 30 and ends 38B in the scanning direction (second direction) of the nozzle plate 38 are exposed through the openings 60*a* of the cover 60. The cover 60 is disposed on the nozzle surface 38*a* at the outside, in the conveying direction (first direction), of the wiper area 71 wiped by the wiper 7 (see FIG. 1).

As depicted in FIG. 7, a distance in the conveying direction between the cover 60 and a nozzle (a nozzle 30*a* in FIG. 7), of the nozzles 30 of each nozzle row 31, disposed at an end in the conveying direction and positioned closest to the cover 60 is defined as a distance D1. A distance in the scanning direction between the nozzle row 31 positioned at an end in the scanning direction and an end in the scanning direction of the nozzle surface 38*a* is defined as a distance D2. In this embodiment, the distance D1 is longer than the distance D2. For example, the distance D1 is about 600 μm and the distance D2 is about 300 μm.

As depicted in FIG. 8, the cover 60 has overlapping portions 61A and non-overlapping portions 61B. The overlapping portions 61A are disposed to overlap with the nozzle surface 38*a* in the up-down direction (third direction). The overlapping portions 61A cover ends in the conveying direction (first direction) of the nozzle surface 38*a*. The non-overlapping portions 61B are disposed not to overlap with the nozzle surface 38*a* in the up-down direction (third direction). As depicted in FIG. 7, the overlapping portion 61A extends in the scanning direction (second direction) along an edge in the conveying direction (first direction) of the opening 60*a* of the cover 60. The non-overlapping portion 61B is adjacent to the overlapping portion 61A in the first direction. The thickness in the up-down direction (third direction) of the overlapping portion 61A is substantially the same as a thickness T in the up-down direction of the non-overlapping portion 61B. The wording, the thickness of the overlapping portion 61A is the same as the thickness T, includes a case in which there is a difference in a range of an error. For example, when the thickness of the overlapping portion 61A is in a range of +5% of the thickness T of the non-overlapping portion 61B, the thickness of the overlapping portion 61A is the same as the thickness T of the non-overlapping portion 61B.

The ink-jet head (liquid jetting apparatus) 3 and the ink-jet printer (liquid jetting apparatus) 1 including the ink-jet head 3 according to this embodiment achieve the following effects.

In this embodiment, as depicted in FIG. 6, the heaters 50 come into thermal contact with the cover 60 to heat the cover 60. As depicted in FIGS. 7 and 8, the cover 60 comes into thermal contact with the nozzle plate 38. In that configuration, the heat generated by the heaters 50 is conducted to the nozzle plate 38 via the cover 60. The heaters 50 can heat the nozzle plate 38 and the ink in the nozzles 30 via the cover 60, thus regulating viscosity of the liquid jetted from the ink-jet head 3. As depicted in FIG. 7, the cover 60 is in contact with the ends 38A in the conveying direction (first direction) of the nozzle plate 38. The nozzles 30 and the ends 38B in the scanning direction (second direction) of the nozzle plate 38 are exposed through the openings 60*a* of cover 60. In this embodiment, the wiper 7 (see, FIG. 1) wipes the nozzle surface 38*a* in the scanning direction during the wiping. The wiper 7 moving on the nozzle surface 38*a* in the scanning direction can clean (wipe) the nozzle surface 38*a* without crossing the steps 62 between the nozzle surface 38*a* and the cover 60. Since the wiper 7 does not cross the steps 62, there is no wiping problem, such as a problem in which parts of the nozzle surface 38*a* in the vicinity of the steps 62 can not be wiped with the wiper 7 and a problem in which the ink and the like collected at the front end of the wiper 7 during the cleaning of the nozzle surface 38*a*, is caught by the steps 62. Accordingly, in this embodiment, it is possible to regulate the viscosity of ink to be jetted from the ink-jet head 3 and to easily clean the nozzle surface 38*a* with the wiper 7.

In this embodiment, as depicted in FIG. 5, the nozzle plate 38 is shorter in the scanning direction (second direction) than the channel forming member 35. Making the nozzle plate 38 a bare minimum size reduces costs. In such a small nozzle plate 38, however, it is difficult to make the nozzle plate 38 contact with the cover 60 satisfactorily, the distance between the nozzles 30 and the cover 60 is shortened and the nozzles 30 are arranged in the vicinity of the cover 60. Especially, it is difficult for the ends 38B in the scanning direction of the nozzle plate 38 to have a space for the contact with the cover 60. In this embodiment, as depicted in FIG. 7, the cover 60 is in contact with the ends 38A in the conveying direction (first direction) of the nozzle plate 38 where the space for the contact with the cover 60 is made easily, and the cover 60 is not in contact with the ends 38B in the scanning direction (second direction). The wiper 7 moving on the nozzle surface 38*a* in the scanning direction moves parallel to the steps 62 without crossing the steps 62 between the nozzle surface 38*a* and the cover 60. Thus, in this embodiment, even when the nozzle plate 38 is small, the nozzle plate 38 can be heated while being reliably brought into contact with the cover 60, and the nozzles 30 in the vicinity of the cover 60 can be easily cleaned (wiped) with the wiper 7.

In this embodiment, as depicted in FIGS. 7 and 8, the cover 60 is disposed at the outside, in the conveying direction (first direction), of the wiper area 71 of the nozzle surface 38*a* wiped by the wiper 7. Since the cover 60 is not in contact with the wiper 7, the cover 60 does not interfere with the cleaning (wiping) of the nozzle surface 38*a* by use of the wiper 7.

In this embodiment, as depicted in FIG. 7, the distance D1 in the conveying direction between the cover 60 and the nozzle 30*a* disposed at the end in the conveying direction (first direction) of each of the nozzle rows 31 is longer than the distance D2 in the scanning direction between the nozzle 30*a* disposed at the end in the scanning direction (second direction), in other words, the nozzle row 31 positioned at the end in the scanning direction and the end in the scanning direction of the nozzle surface 38*a*. Making the distance D1 between the nozzle 30*a* and the cover 60 sufficiently long allows the wiper 7 to reliably clean the nozzles in the vicinity of the cover 60.

In this embodiment, as depicted in FIGS. 7 and 8, the cover 60 includes the overlapping portions 61A that are disposed to overlap with the nozzle surface 38*a* in the up-down direction (third direction) to cover the ends in the conveying direction (first direction) of the nozzle surface 38*a* and the non-overlapping portions 61B that are disposed not to overlap with the nozzle surface 38*a* in the up-down direction. The thickness in the up-down direction (third direction) of the overlapping portion 61A is substantially the same as the thickness T in the up-down direction of the non-overlapping portion 61B. Making the thickness of the overlapping portions 61A substantially the same as the thickness of the non-overlapping portions 61B keeps mechanical strength of the overlapping portions 61A and the non-overlapping portions 61B, resulting in satisfactory contact strength between the overlapping portions 61A and the nozzle surface 38*a*. Accordingly, the heat generated by the heaters 50 is efficiently conducted to the nozzle plate 38 through the cover 60.

In this embodiment, as depicted in FIG. 4, the heaters 50 are electrically connected to the circuit board (rigid board) 23 by the wiring members 51. The circuit board 23 is electrically connected to the piezoelectric elements (actuators, see FIG. 6) 39 by use of the CORs 22. The configuration in which the heaters 50 and the piezoelectric elements 39 are connected to the same circuit board 23 eliminates another circuit board for heaters.

In this embodiment, as depicted in FIGS. 5 and 6, the heaters 50 are provided on both sides in the scanning direction (second direction) of the nozzle plate 38. In that configuration, the heaters 50 can heat not only the ink in the nozzle plate 38 via the cover 60 but also the ink in the ink supply channels 34 and the manifolds 42 through the outer walls of the holder member 32 and the channel forming member 35. Heating the ink in the ink-jet head 3 on the upstream side simultaneously with the ink in the ink-jet head 3 on the downstream side can easily regulate the viscosity of liquid to be jetted from the ink-jet head 3.

Figure 9:
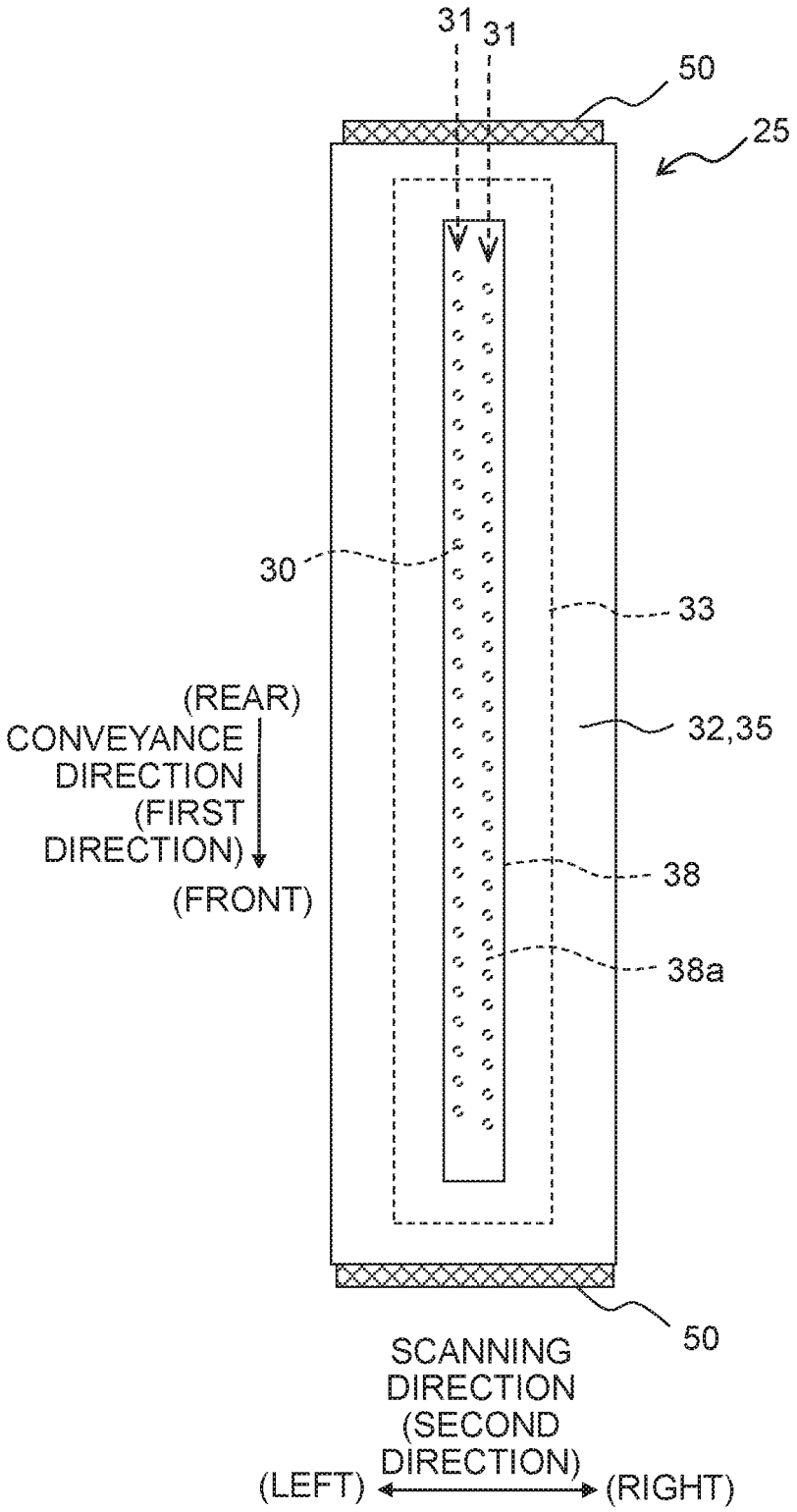
FIG. 9 is a plan view schematically depicting the head unit and heaters that are provided on both sides in a conveying direction of the head unit.

In this embodiment, the heaters 50 are provided on both sides in the scanning direction (second direction) of the nozzle plate 38. The present teaching, however, is not limited thereto. For example, as depicted in FIG. 9, the heaters 50 may be provided on both sides in the conveying direction (first direction) of the nozzle plate 38. When the heaters 50 are provided on both sides in the scanning direction, a width in the scanning direction including the head unit 25 and the heaters 50 is large. In that configuration, when the head unit 25 is inclined to the scanning direction, liquid (e.g., ink) may have a large landing position deviation. When the heaters 50 are provided on both sides in the conveying direction (first direction) of the nozzle plate 38, it is possible to reduce such a landing position deviation. When the heaters 50 are provided on both sides in the conveying direction (first direction) of the nozzle plate 38, it is possible to shorten the distance between each heater 50 and the contact point at which the nozzle plate 38 is in contact with the cover 60. This can reduce a heat radiation loss which may otherwise be generated between the heaters 50 and the nozzle plate 38.

Figure 10:
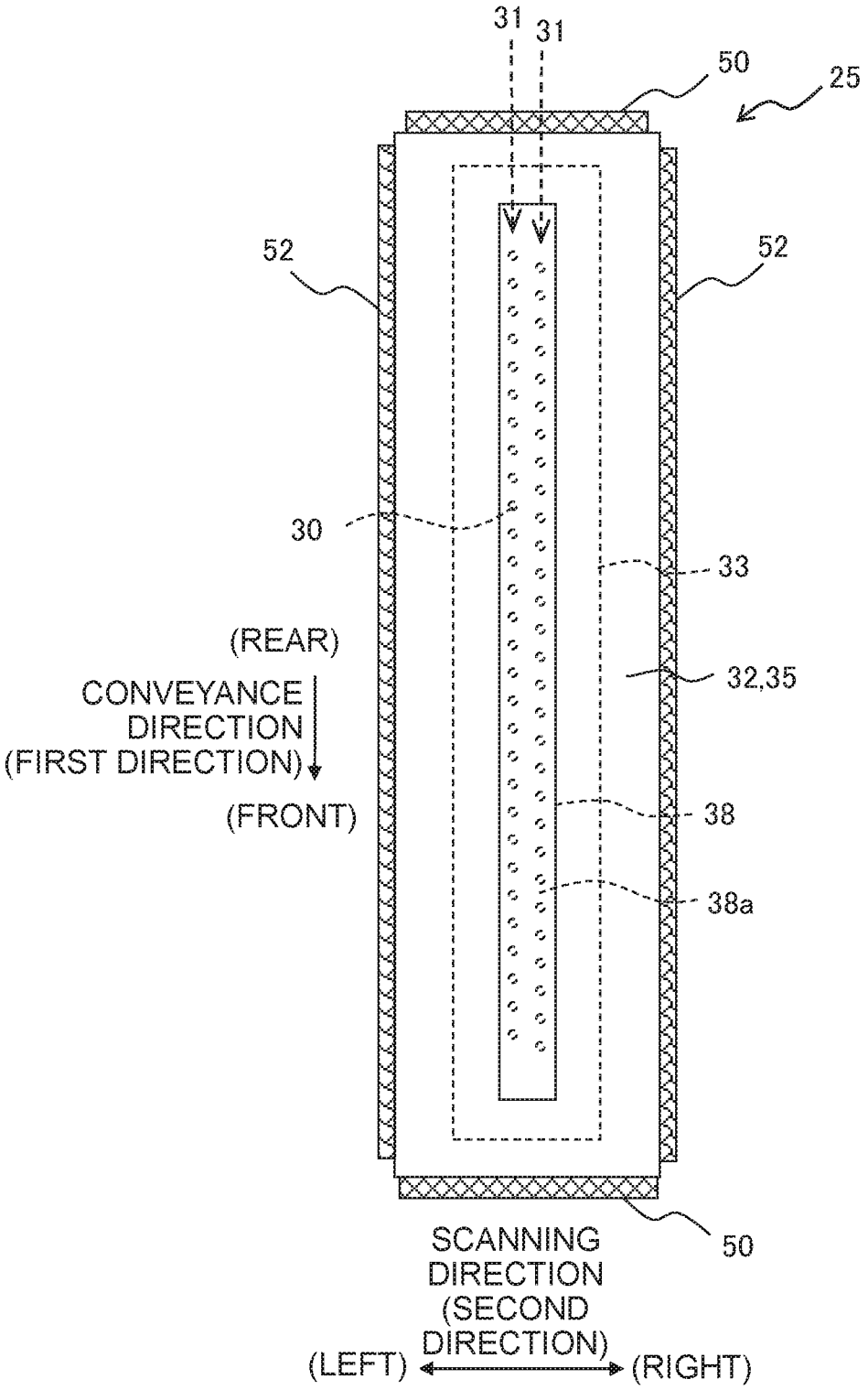
FIG. 10 is a plan view schematically depicting the head unit, the heaters, and manifold heaters.

When the heaters 50 are provided on both sides in the conveying direction of the nozzle plate 38, as depicted in FIG. 10, manifold heaters 52 may be further provided on both sides in the scanning direction (second direction) of the nozzle plate 38. The manifold heaters 52 do not come into thermal contact with the nozzle plate 38. The heaters 50 heat the ink in the nozzle plate 38 and the manifold heaters 52 heat the ink in the manifolds 42. Accordingly, the temperature of ink in the manifolds 42 can be controlled separately from the temperature of ink in the nozzle plate 38. In FIGS. 9 and 10, the cover 60 is omitted (not depicted) for easy understanding of the positional relation between the head unit 25, the heaters 50, the manifold heaters 52.

In this embodiment, the heaters 50 are in direct contact with the cover 60. The present teaching, however, is not limited thereto. The heaters 50 may be in contact with the cover 60 via a heat conductive material such as a thermal conduction adhesive. For example, bringing the heaters 50 into contact with the cover 60 via a grease-like thermal conduction adhesive can efficiently conduct heat from the heaters 50 to the cover 60.

As described above, the liquid jetting head according to the present teaching is capable of regulating the viscosity of liquid to be jetted from the liquid jetting head through heating of the nozzle plate, and is capable of easily cleaning (wiping) the nozzle surface with the wiper.

First to Third Modified Examples

In the above embodiment, the ink-jet head 3 provided with the cover 60 having the shape depicted in FIG. 8 and the ink-jet printer 1 including the ink-jet head 3 are explained. The present teaching, however, is not limited thereto. In the following, first to third modified examples of the above embodiment are explained. The first to third modified examples have the same configuration as the above embodiment except that the shape of the cover 60 is different therefrom. The first to third modified examples have the same effects as the above embodiment.

Figure 11:
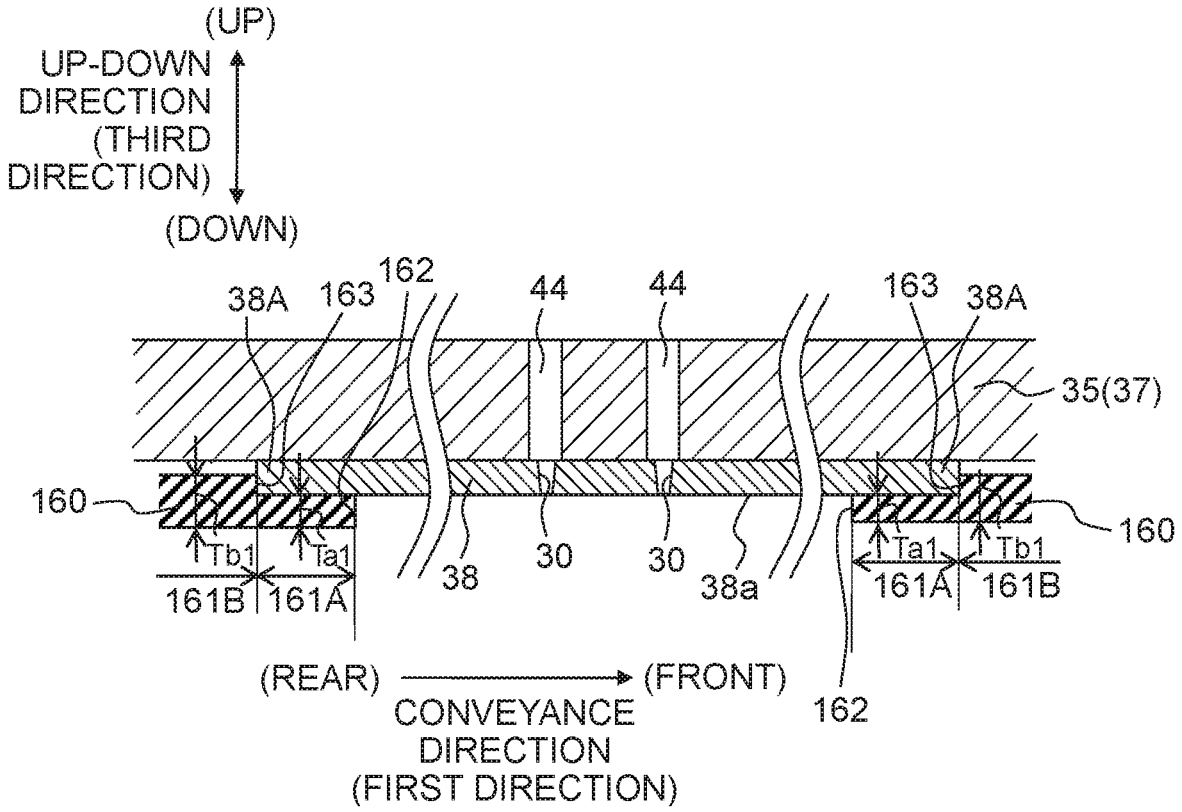
FIG. 11 is a cross-sectional view schematically depicting a cover and a nozzle plate according to a first modified example of the embodiment.

A cover 160 of a first modified example depicted in FIG. 11 has overlapping portions 161A and non-overlapping portions 161B. The overlapping portion 161A has a thickness Ta1 in the up-down direction (third direction), and the non-overlapping portion 161B has a thickness Tb2 in the up-down direction. The thickness Ta1 is thinner than the thickness Tb2. The overlapping portions 161A are thinner in the third direction than the non-overlapping portions 161B. On the nozzle plate 38 side of the cover 160 (on an upper surface of the cover 160), the non-overlapping portion 161B extends beyond the overlapping portion 161A in a direction toward the channel forming member 35. Stepped surfaces (uneven surfaces) 163 parallel to the up-down direction are each formed at a connection portion between the overlapping portion 161A and the non-overlapping portion 161B. Namely, the surface of the non-overlapping portion 161B on the channel forming member 35 side is disposed closer to the channel forming member 35 than the surface of the overlapping portion 161A on the channel forming member 35 side. Namely, the upper surface of the non-overlapping portion 161B is disposed above the upper surface of the overlapping portion 161A. The stepped surface 163 parallel to the third direction connects the upper surface of the non-overlapping portion 161B and the upper surface of the overlapping portion 161A. End surfaces in the first direction of the nozzle plate 38 are in contact with the stepped surfaces 163. A lower surface of the cover 160 is substantially flat. The thickness Ta1 is, for example, 50 to 70 μm. The thickness Tb1 is, for example, 100 to 120 μm.

In the first modified example, making the thickness Ta1 of the overlapping portions 161A thinner than the thickness Tb1 of the non-overlapping portions 161B makes the steps 162 formed between the nozzle surface 38*a* and the cover 160 small. This makes cleaning (wiping) of the nozzle surface 38*a* with the wiper 7 easier. Further, since the end surfaces in the first direction of the nozzle plate 38 are in contact with the stepped surfaces 163, the contact area between the cover 160 and the nozzle plate 38 increases and heat can be efficiently conducted from the cover 160 to the nozzle plate 38.

Figure 12:
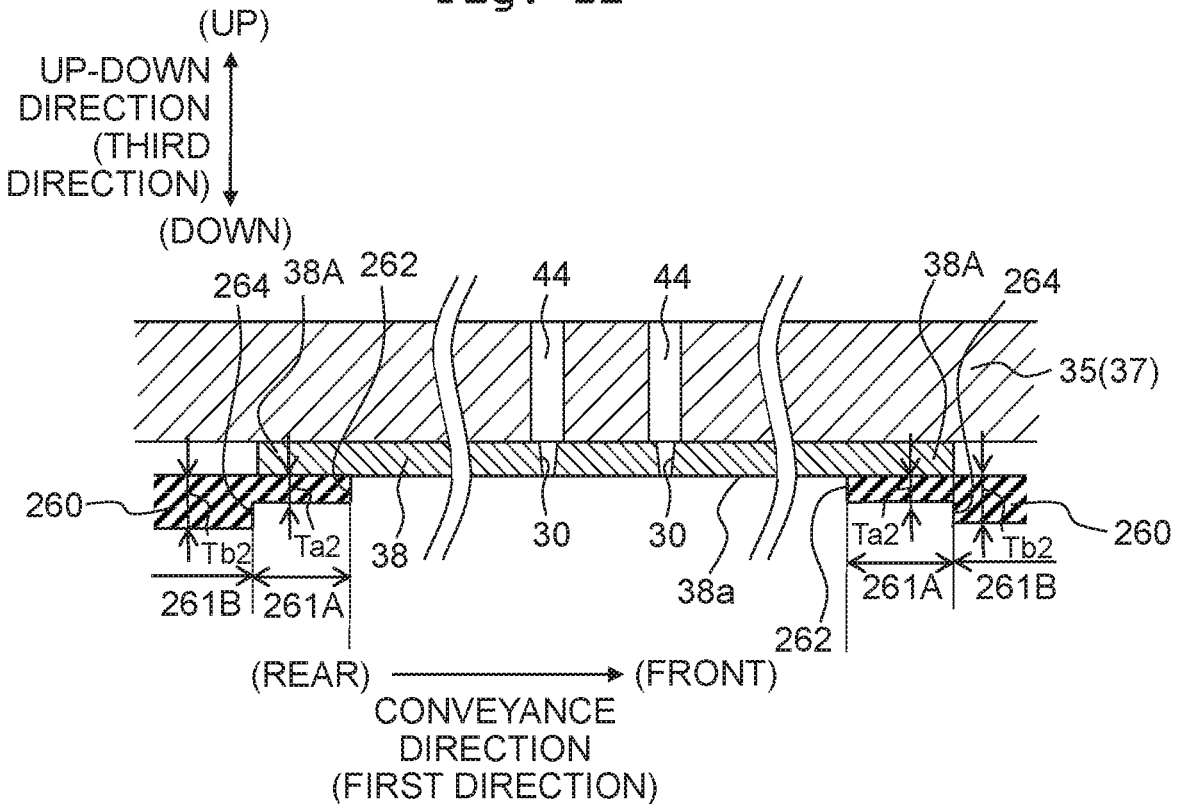
FIG. 12 is a cross-sectional view schematically depicting a cover and a nozzle plate according to a second modified example of the embodiment.

In a cover 260 of a second modified example depicted in FIG. 12, overlapping portions 261A have a thickness Ta2 in the up-down direction (third direction) and non-overlapping portions 261B have a thickness Tb2 in the up-down direction. Similar to the first modified example depicted in FIG. 11, the thickness Ta2 is thinner than the thickness Tb2. In the second modified example, on the side of the cover 260 opposite to the nozzle plate 38 (on a lower surface of the cover 260), the non-overlapping portion 261B extends beyond the overlapping portion 261A in a direction away from the channel forming member 35. Stepped surfaces (uneven surfaces) 264 parallel to the up-down direction are each formed at a connection portion between the overlapping portion 261A and the non-overlapping portion 261B. In other words, the surface of the non-overlapping portion 261B opposite to the channel forming member 35 is disposed farther from the channel forming member 35 than the surface of the overlapping portion 261A opposite to the channel forming member 35. Namely, the lower surface of the non-overlapping portion 261B is disposed below the lower surface of the overlapping portion 261A. The stepped surface 264 parallel to the third direction connects the lower surface of the non-overlapping portion 261B and the lower surface of the overlapping portion 261A. An upper surface of the cover 260 is substantially flat. The thickness Ta2 is, for example, 50 to 70 μm. The thickness Tb2 is, for example, 100 to 120 μm.

In the second modified example, similar to the first modified example, making the thickness Ta2 of the overlapping portions 261A thinner than the thickness Tb2 of the non-overlapping portions 261B makes the steps 262 formed between the nozzle surface 38*a* and the cover 260 small. This makes cleaning (wiping) of the nozzle surface 38*a* with the wiper 7 easier.

Figure 13:
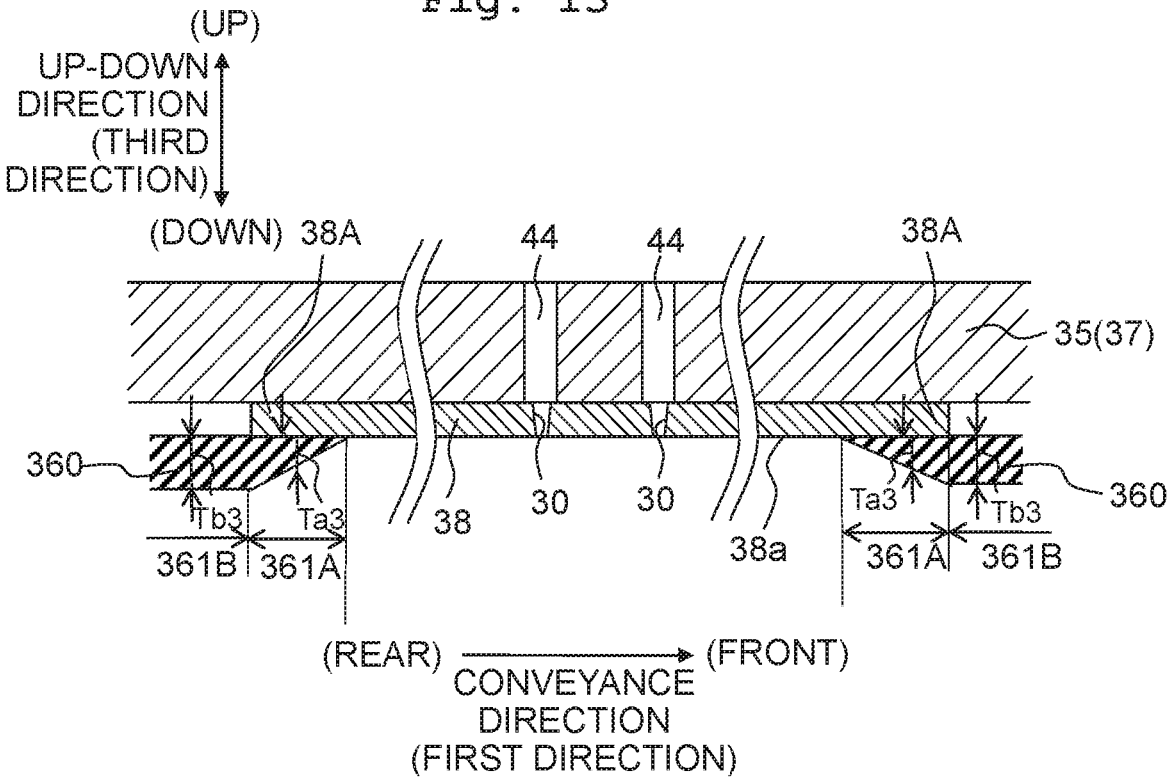
FIG. 13 is a cross-sectional view schematically depicting a cover and a nozzle plate according to a third modified example of the embodiment.

In a cover 360 of a third modified example depicted in FIG. 13, overlapping portions 361A have a thickness Ta3 in the up-down direction and non-overlapping portions 361B have a thickness Tb3 in the up-down direction. Similar to the first and second modified examples depicted in FIGS. 11 and 12, the thickness Ta3 is thinner than the thickness Tb3. In upper and lower surfaces of the cover 360 according to the third modified example, no stepped surface is formed between the overlapping portion 361 and the non-overlapping portion 361B. In the third modified example, the lower surface of the overlapping portion 361A (i.e., the surface that is not in contact with the nozzle plate 38) is inclined so that the lower surface approaches the nozzle surface 38*a* as the lower surface approaches the nozzle 30. Namely, the thickness Ta3 of the overlapping portion 361A is thinner toward the nozzle 30. The thickness Tb3 is, for example, 100 to 120 μm, and the angle of the lower surface of the overlapping portion 361A to the nozzle surface 38*a* is, for example, approximately 30°.

In the third modified example, no stepped surface is formed between the overlapping portion 361A and the non-overlapping portion 361B, and no step is formed between the nozzle surface 38*a* and the cover 360. The lower surface of the overlapping portion 361A is inclined. This makes cleaning (wiping) of the nozzle surface 38*a* with the wiper 7 easier.

Fourth Modified Example

Figure 14:
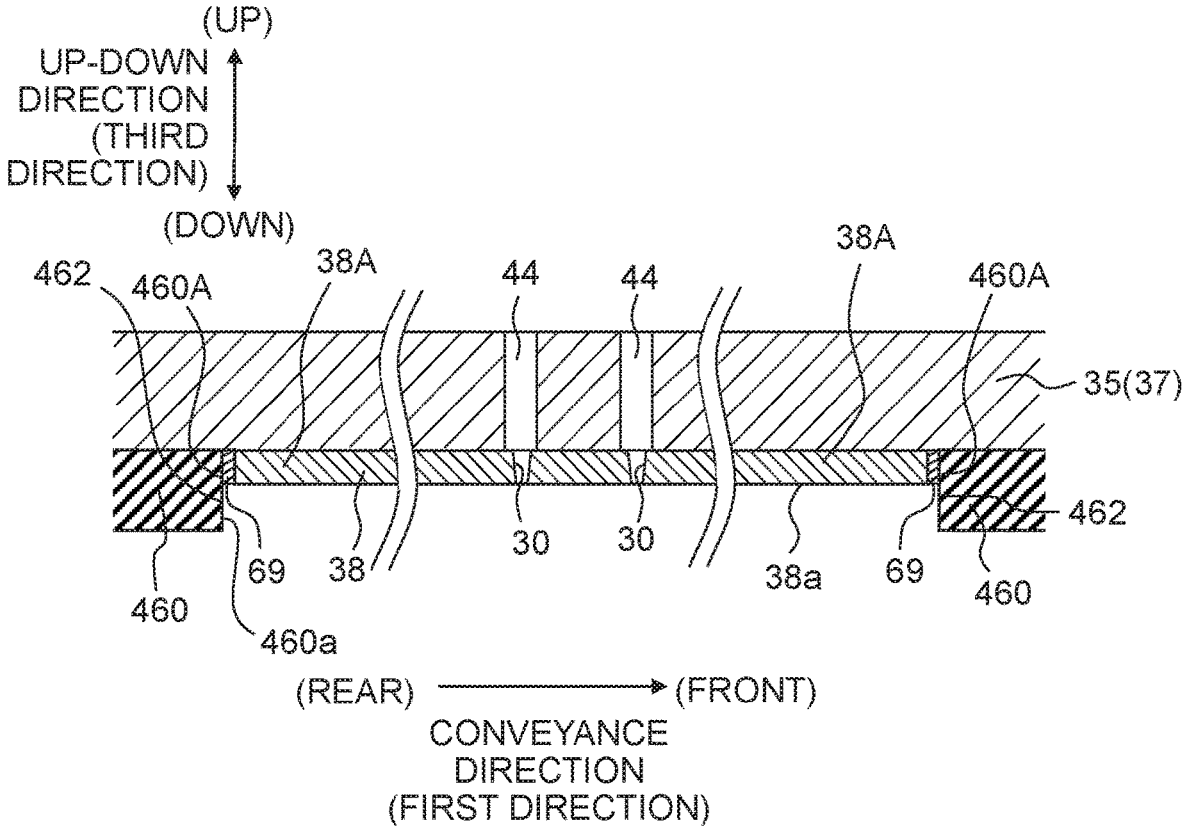
FIG. 14 is a cross-sectional view schematically depicting a cover and a nozzle plate according to a fourth modified example of the embodiment.

A fourth modified example of the above embodiment depicted in FIG. 14 is explained. Unlike the above embodiment, a cover 460 of the fourth modified example has no overlapping portions disposed to overlap with the nozzle surface 38*a* in the up-down direction (third direction). In this modified example, the cover 460 has an opening 460*a* through which not only the nozzles 30 and the both ends 38B (see FIG. 7) in the scanning direction (second direction) of the nozzle plate 38 are exposed, but also the both ends 38A in the conveying direction (first direction) of the nozzle plate 38 are exposed. Namely, in this modified example, the entirety of the nozzle plate 38 is exposed through the opening 460*a*. Edges 460A, of the opening 460*a* of the cover 460, in the conveying direction are disposed on both sides in the conveying direction of the nozzle plate 38. An upper surface of the cover 460 is connected to the lower surface of the channel forming member 35. The edges 460A in the conveying direction of the opening 460*a* of the cover 460 come into thermal contact with the ends 38A in the first direction of the nozzle plate 38. More specifically, the edges 460A in the first direction of the opening 460*a* of the cover 460 are in contact with the ends 38A of the nozzle plate 38 via a thermal conduction adhesive 69. The fourth modified example has the same configuration as the above embodiment except for the positional relation between the nozzle plate 38 and the cover 460, and thus the fourth modified example has the same effects as the above embodiment.

In the fourth modified example, the cover 460 has no overlapping portions disposed to overlap with the nozzle surface 38*a*. This makes steps 462 each formed between the nozzle surface 38*a* and the cover 460 small. This makes cleaning (wiping) of the nozzle surface 38*a* with the wiper 7 easier.

The embodiment and the modified examples described above are examples in which the present teaching is applied to the ink-jet head that jets ink on a recording medium to print an image and the like and the ink-jet printer. The present teaching, however, is applicable to liquid jetting heads and liquid jetting apparatuses that are used for various uses other than the printing of an image and the like. For example, the present teaching is applicable to a liquid jetting apparatus that jets conductive liquid on a substrate to form a conductive pattern on a surface of the substrate.

What is claimed is:

1. A liquid jetting head, comprising:

a nozzle plate extending in a first direction and having first ends in the first direction, second ends in a second direction orthogonal to the first direction, and a nozzle surface in which nozzles are open, the nozzles being aligned on the nozzle surface in the first direction to form nozzle rows;

a cover which is in thermal contact with the first ends of the nozzle plate; and at least one heater which is in thermal contact with the cover and which is configured to heat the cover, wherein the first direction corresponds to a lengthwise direction of the nozzle plate and the second direction corresponds to a widthwise direction of the nozzle plate, the second direction being shorter than the first direction, and wherein the cover exposes the nozzles and the second ends of the nozzle plate.

2. The liquid jetting head according to claim 1, further comprising a channel forming member which includes liquid channels respectively communicating with the nozzles and which is connected to a surface of the nozzle plate on a side opposite to the nozzle surface, wherein the nozzle plate is shorter in a second direction than the channel forming member, the second direction being orthogonal to the first direction.

3. The liquid jetting head according to claim 1, wherein the cover is disposed on a side of the nozzle surface of the nozzle plate and has an opening through which the nozzles are exposed, the cover comprises:

overlapping portions which extend in the second direction, along edges in the first direction of the opening, and which overlap with the nozzle surface in a third direction perpendicular to the first direction and the second direction to cover the first ends of the nozzle surface; and non-overlapping portions each of which is disposed adjacent to one of the overlapping portions in the first direction not to overlap with the nozzle surface in the third direction.

4. The liquid jetting head according to claim 3, wherein a thickness in the third direction of the overlapping portions is identical to a thickness in the third direction of the non-overlapping portions.

5. A liquid jetting head, comprising:

a nozzle plate extending in a first direction and having first ends in a first direction, second ends in a second direction orthogonal to the first direction, and a nozzle surface in which nozzles are open, the nozzles being aligned on the nozzle surface in the first direction to form nozzle rows;

a cover which is in thermal contact with the first ends of the nozzle plate, and is disposed on a side of the nozzle surface of the nozzle plate and has an opening through which the nozzles are exposed, wherein the cover comprises:

overlapping portions which extend in the second direction, along edges in the first direction of the opening, and which overlap with the nozzle surface in a third direction perpendicular to the first direction and the second direction to cover the first ends of the nozzle surface; and non-overlapping portions each of which is disposed adjacent to one of the overlapping portions in the first direction not to overlap with the nozzle surface in the third direction, and at least one heater which is in thermal contact with the cover and which is configured to heat the cover, wherein the first direction corresponds to a lengthwise direction of the nozzle plate and the second direction corresponds to a widthwise direction of the nozzle plate, the second direction being shorter than the first direction, and wherein the overlapping portions are thinner in the third direction than the non-overlapping portions.

6. The liquid jetting head according to claim 5, further comprising a channel forming member which includes liquid channels respectively communicating with the nozzles and which is connected to a surface of the nozzle plate on a side opposite to the nozzle surface, wherein the non-overlapping portions extend beyond the overlapping portions in a direction toward the channel forming member, and stepped surfaces parallel to the third direction are formed between the overlapping portions and the non-overlapping portions, and end surfaces of the nozzle plate in the first direction are in contact with the stepped surfaces.

7. A liquid jetting head comprising:

a nozzle plate extending in a first direction and having first ends in the first direction, second ends in a second direction orthogonal to the first direction, and a nozzle surface in which nozzles are open, the nozzles being aligned on the nozzle surface in the first direction to form nozzle rows;

a cover which is in thermal contact with the first ends of the nozzle plate, and is disposed on a side of the nozzle surface of the nozzle plate and has an opening through which the nozzles are exposed, wherein the cover comprises:

overlapping portions which extend in the second direction, along edges in the first direction of the opening, and which overlap with the nozzle surface in a third direction perpendicular to the first direction and the second direction to cover the first ends of the nozzle surface; and non-overlapping portions each of which is disposed adjacent to one of the overlapping portions in the first direction not to overlap with the nozzle surface in the third direction;

at least one heater which is in thermal contact with the cover and which is configured to heat the cover; and a channel forming member which includes liquid channels respectively communicating with the nozzles and which is connected to a surface of the nozzle plate on a side opposite to the nozzle surface, wherein the first direction corresponds to a lengthwise direction of the nozzle plate and the second direction corresponds to a widthwise direction of the nozzle plate, the second direction being shorter than the first direction, and wherein the non-overlapping portions extend beyond the overlapping portions in a direction away from the channel forming member, and stepped surfaces parallel to the third direction are formed between the overlapping portions and the non-overlapping portions.

8. The liquid jetting head according to claim 5, wherein surfaces of the overlapping portions which are not in contact with the nozzle plate are inclined so that the surfaces approach the nozzle surface as the surfaces approach the nozzles.

9. The liquid jetting head according to claim 1, wherein the cover has an opening through which the nozzles and the first ends of the nozzle plate are exposed, and edges in the first direction of the opening are in thermal contact with the first ends of the nozzle plate.

10. The liquid jetting head according to claim 9, wherein the edges in the first direction of the opening are in contact with the first ends of the nozzle plate via a thermal conduction adhesive.

11. The liquid jetting head according to claim 1, wherein the at least one heater is in contact with the nozzle plate via a thermal conduction adhesive.

12. The liquid jetting head according to claim 1, wherein the at least one heater comprises heaters arranged on opposite sides of the nozzle plate in the second direction.

13. The liquid jetting head according to claim 1, wherein the at least one heater comprises heaters arranged on opposite sides of the nozzle plate in the first direction.

14. The liquid jetting head according to claim 13, further comprising:

a channel forming member provided with a manifold which contains a liquid to be jetted from the nozzles, and connected to a surface of the nozzle plate on a side opposite to the nozzle surface; and manifold heaters configured to heat the liquid in the manifold, wherein the manifold heaters arranged on both sides of the nozzle plate in the second direction.

15. The liquid jetting head according to claim 1, further comprising:

a channel forming member which is provided with liquid channels respectively including pressure chambers which respectively communicate with the nozzles, and which has a first surface connected to a surface of the nozzle plate on a side opposite to the nozzle surface, actuators connected to a second surface of the channel forming member on a side opposite to the first surface, and configured to generate change in pressure in the pressure chambers, thereby jetting a liquid from the nozzles; and a rigid board to which the actuators are electrically connected, wherein the at least one heater is electrically connected to the rigid board.

16. The liquid jetting head according to claim 1, wherein the nozzle rows are arranged in the second direction, and a distance in the first direction between the cover and one of the nozzles disposed at an end of each of the nozzle rows is longer than a distance in the second direction between one of the nozzle rows positioned at an end in the second direction and an end of the nozzle surface in the second direction.

17. A liquid jetting apparatus, comprising:

the liquid jetting head as defined in claim 1; and a wiper configured to wipe the nozzle surface of the liquid jetting head.

18. The liquid jetting apparatus according to claim 17, wherein the wiper is configured to wipe the nozzle surface along the second direction.

19. The liquid jetting apparatus according to claim 18, wherein the cover is disposed outside of a wiper area of the nozzle surface in the first direction, the wiper area configured to be wiped by the wiper.

* * * * *